US008220123B2

(12) United States Patent
Wark

(10) Patent No.: US 8,220,123 B2
(45) Date of Patent: Jul. 17, 2012

(54) METHOD AND APPARATUS FOR CONVERTING COAL CLASSIFIER OUTLET TO TURRET ADAPTED FOR DIFFUSION TECHNOLOGY

(76) Inventor: Rickey E. Wark, Spring, TX (US)

( * ) Notice: Subject to any disclaimer, the term of this patent is extended or adjusted under 35 U.S.C. 154(b) by 445 days.

(21) Appl. No.: 12/631,071

(22) Filed: Dec. 4, 2009

(65) Prior Publication Data

US 2011/0133009 A1 Jun. 9, 2011

(51) Int. Cl.
*B21K 21/16* (2006.01)
*B02C 23/00* (2006.01)
*F23K 3/00* (2006.01)

(52) U.S. Cl. ..... 29/401.1; 241/285.1; 110/106

(58) Field of Classification Search ..... 29/401.1, 29/426.1; 241/285.1, 285.2; 110/106
See application file for complete search history.

(56) References Cited

U.S. PATENT DOCUMENTS 5,819,947 A * 10/1998 Nardi et al. ..... 209/139.2
6,257,415 B1 7/2001 Wark
D531,296 S 10/2006 Chen
D556,802 S 12/2007 Katayama

* cited by examiner

*Primary Examiner* — John C Hong
(74) *Attorney, Agent, or Firm* — Young Basile Hanlon & MacFarlane PC

(57) ABSTRACT

The OEM Venturi and outlet structures of a conventional coal classifier are removed and replaced with a simple turret having four outlet openings which are connected to the combustion chamber feed conduits. The Venturi and kidney-shaped transition tubes of the OEM structure are scrapped.

7 Claims, 7 Drawing Sheets

METHOD AND APPARATUS FOR CONVERTING COAL CLASSIFIER OUTLET TO TURRET ADAPTED FOR DIFFUSION TECHNOLOGY

FIELD OF THE INVENTION

This invention relates to pulverizers/classifiers for coal and more particularly to a method and apparatus for replacing the OEM multiport outlet of a conventional updraft classifier with a turret capable of being fitted with diffusion elements.

BACKGROUND OF THE INVENTION

Large machines called pulverizers/classifiers are used to crush and pulverize lump coal into powdered fines for injection into a combustion chamber where heat is generated to turn water into steam in coal-fired utility plants. Several types of commercial pulverizer/classifier machines are available in the commercial market, one of which is shown for illustration purposes in FIGS. 1 through 3 of this application. As shown in FIGS. 1-3, the OEM classifier multiport outlet structure is installed in a circular opening 14 in the top of the inverted-bottle-shaped upper housing 16 of the classifier 10. The OEM structure comprises a cylindrical skirt 72 concentric with the opening 14 and extending down into the classifier housing in surrounding, spaced relationship with the coal inlet chute 12.

Mounted concentrically with and partially inside of the skirt 72 is a Venturi 70 comprising a diverging lower cone 74 integral with a converging upper cone 76. The cone 76 is joined to the skirt 72 by angled radial vanes 78 and the lower cone 74 is secured to the chute 12 by welding or other known means.

On top of the Venturi 70 is an outlet structure comprising a heavy steel circular plate 82 with spaced bolt holes. Cut into the plate are four kidney-shaped outlet holes. Cast steel tubes 84, 86, 88 and 90 sit on and over these holes. The bottoms of the tubes 84, 86, 88 are kidney-shaped to match the holes in plate 82. Flanges 92, 94, 96 and 98 are integral with the tubes 84, 86, 88 and 90 respectively and have bolt holes drilled in them for mounting purposes.

The bodies of tubes 84, 86, 88 and 90 change shape vertically from a kidney-shape near the bottom to a circular shape near the top flanges 100, 102, 104 and 106. Those flanges are provided with bolt holes for attachment to coal conduits 46, 48, 50 and 52 shown in FIG. 3 as part of a system modified to receive the present invention as hereinafter described.

SUMMARY OF THE INVENTION

The present invention provides a method and apparatus for replacing or retrofitting the outlet structure shown in FIGS. 1-3, particularly the Venturi 70, plate 82 and transition tubes 84, 86, 88 and 90, and in many cases the skirt 72, with a simpler, lighter and less expensive structure which is adaptable to the use of diffusion devices of a type hereinafter described.

The invention comprises the steps of removing the OEM outlet structure of the classifier including the disconnection of the transition tubes from the combustion chamber feed conduits, reconditioning, as necessary, the collar flange around the classifier top opening, installing a flared turret onto the opening, and connecting outlets in the top wall of the turret to the combustion chamber feed conduits. Where desired, the method may also involve removal of the skirt and fitting a new deeper skirt around the inlet chute.

The turret entirely replaces the four transition tubes described above and eliminates the heavy Venturi structure in its entirety. Coal fines flow into the skirt and then into the annular volume defined by and between the turret wall and the coal inlet chute. From this volume, coal fines exit the turret into the four, circular outlets which are connected to the feed conduits.

If desired, the skirt may be fitted with a diffusion device such as the multi-spin mixer described in U.S. Pat. No. 6,899,041 issued May 31, 2005.

As will be apparent to persons skilled in the art, the use of wear resistant materials such as any of various carbides and cermet materials are preferably added to high wear locations to extend and optimize the life of the assembly.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
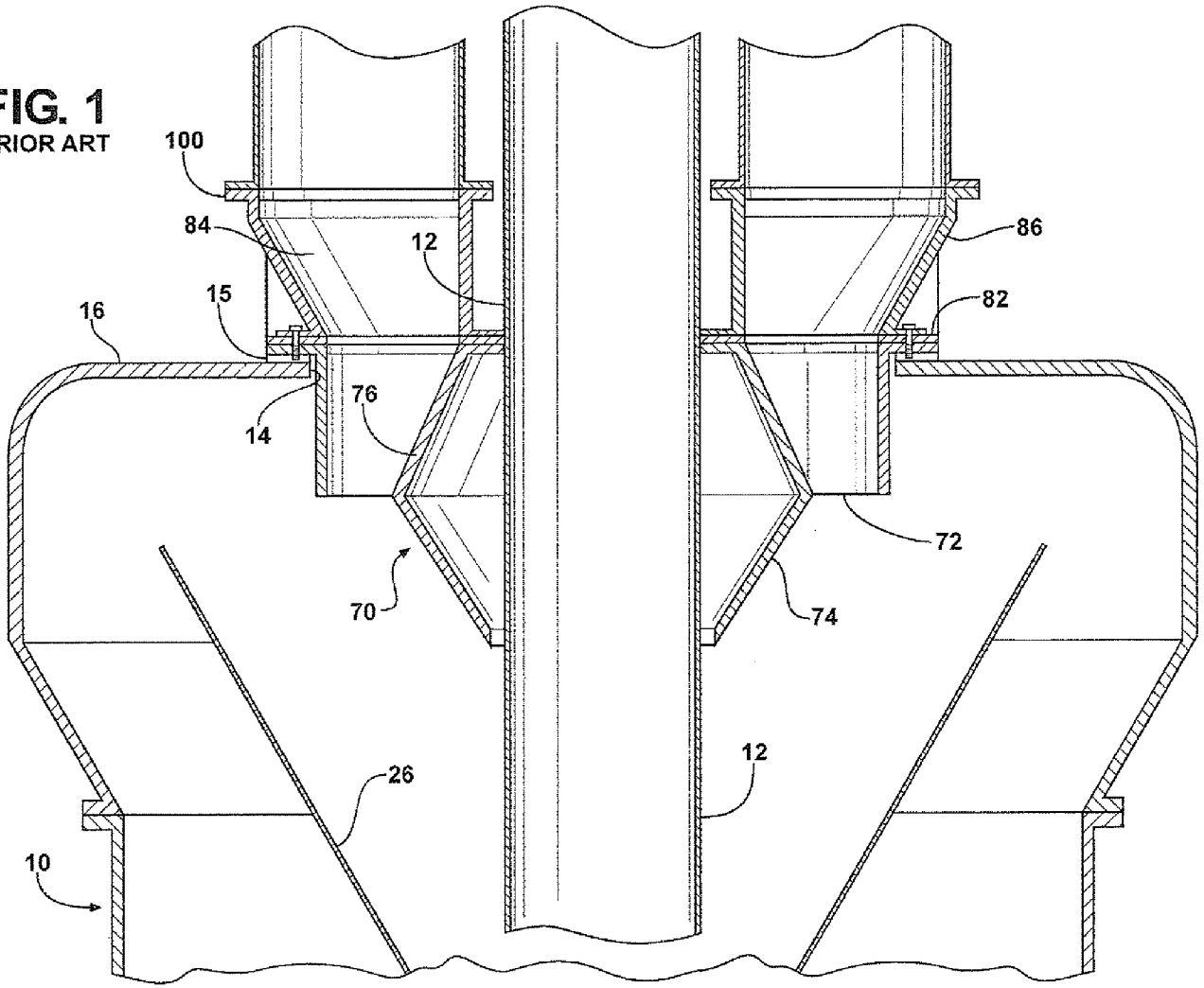
FIG. 1 PRIOR ART
FIG. 1 is a cross-sectional view of the upper structure of a pulverizer classifier with an OEM outlet using a Venturi and transition tubes.
Figure 2:
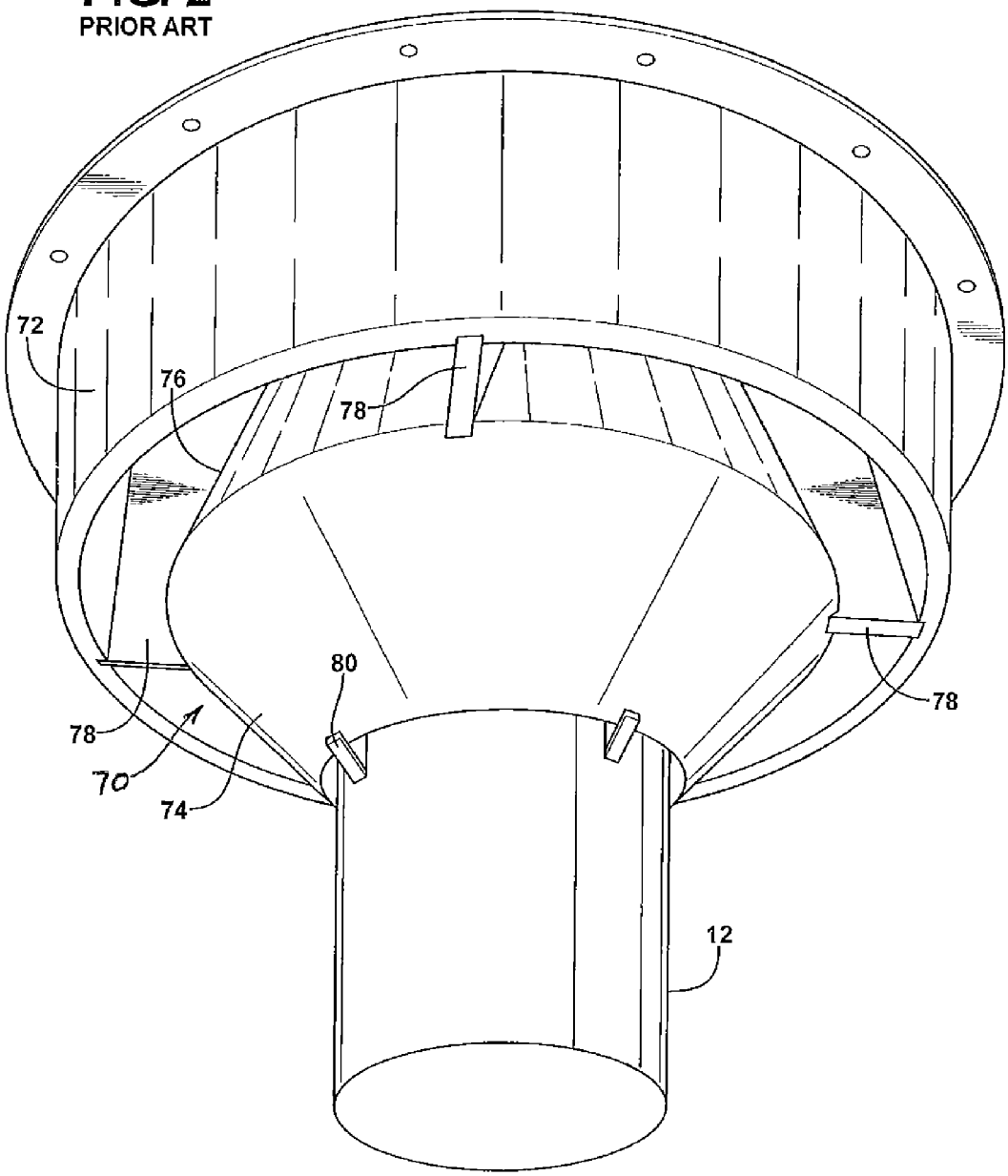
FIG. 2 PRIOR ART
FIG. 2 is a perspective drawing of the Venturi and skirt in the OEM outlet structure of FIG. 1.
Figure 3:
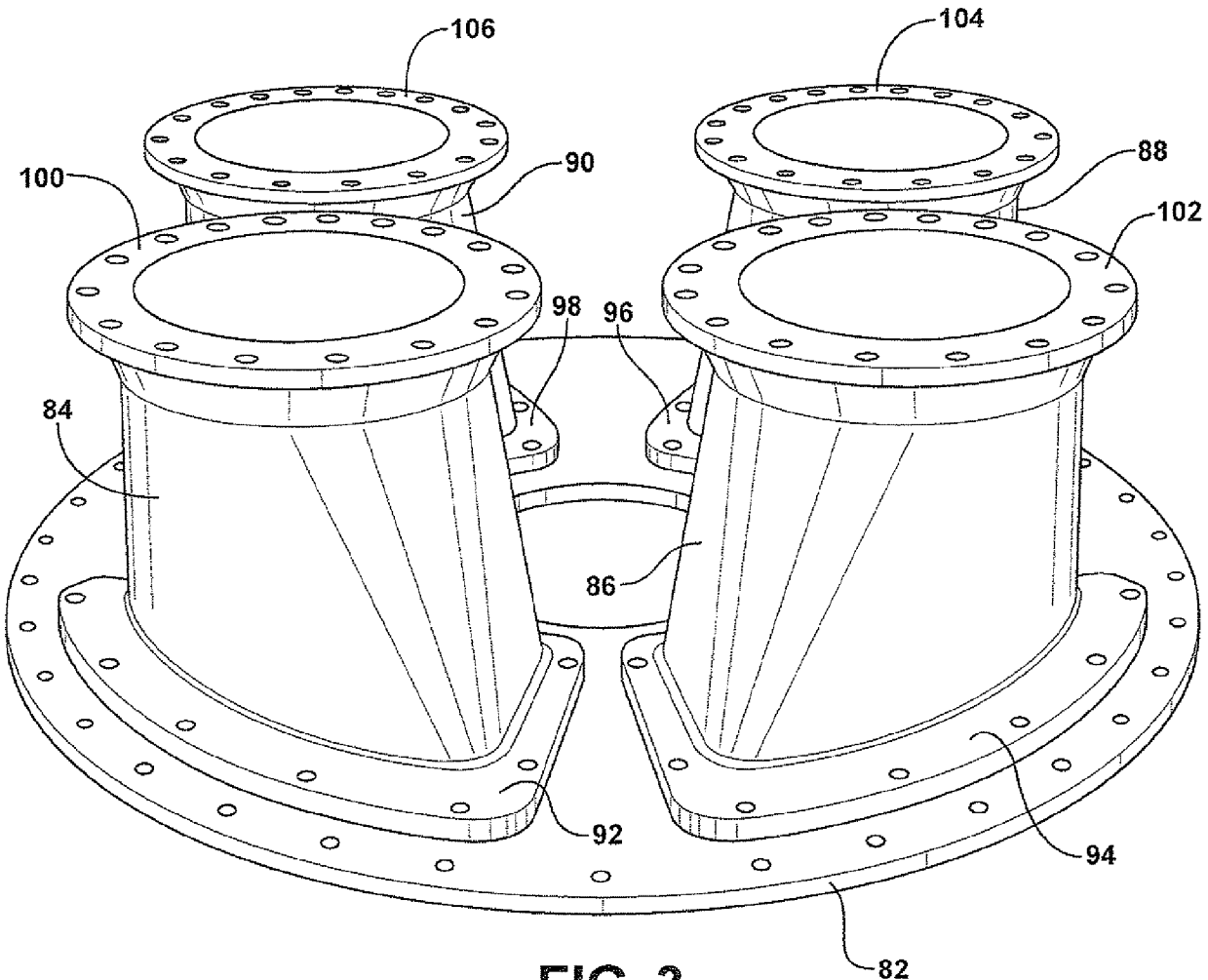
FIG. 3 PRIOR ART
FIG. 3 is a perspective drawing of the outlet transition tubes of FIG. 1 arranged around a four-hole plate mounted to the top of the classifier as shown in FIG. 1.
Figure 4:
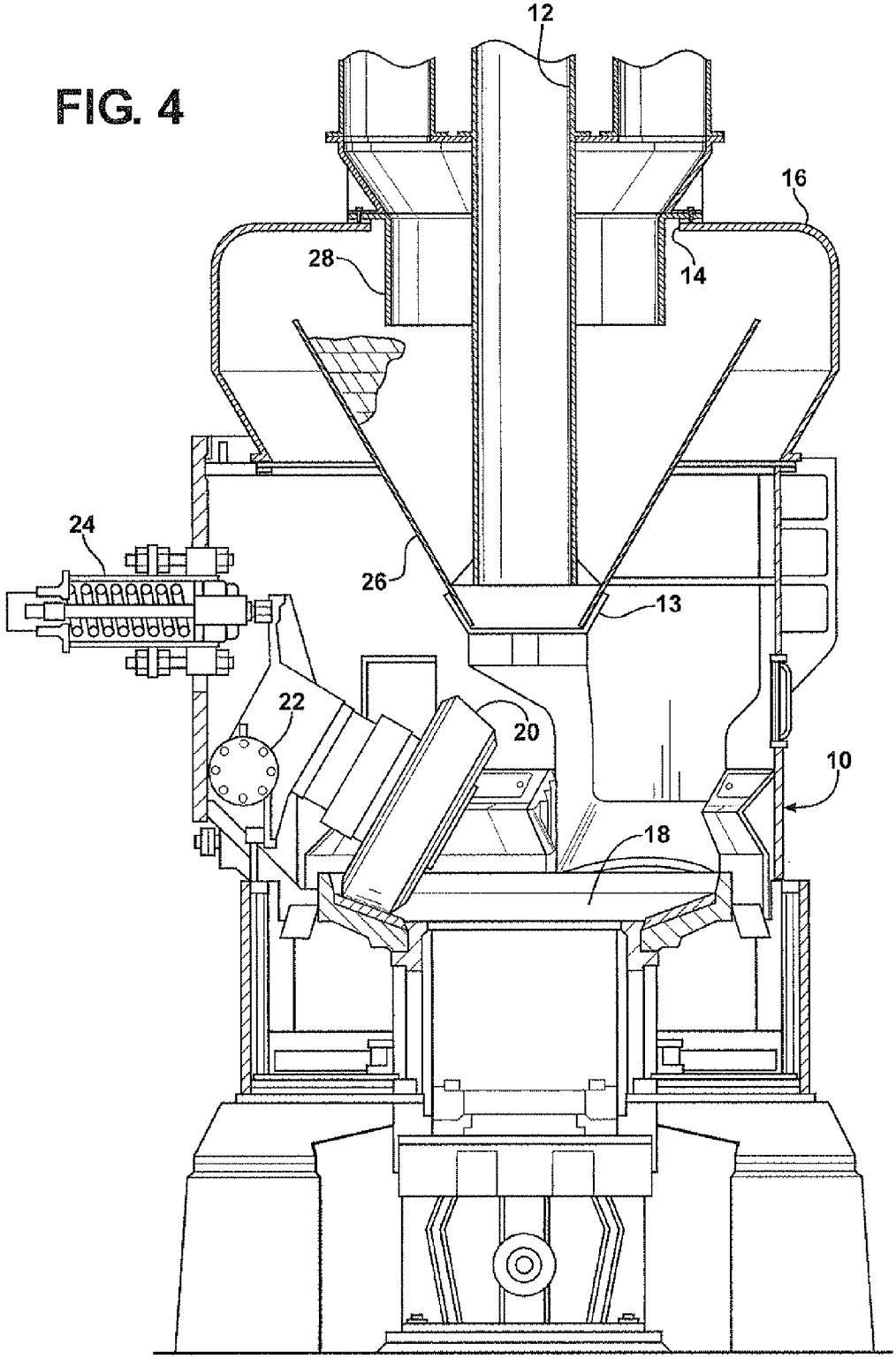
FIG. 4 is a cross-sectional view of a commercial pulverizer/classifier after installation of the new turret structure.
Figure 5:
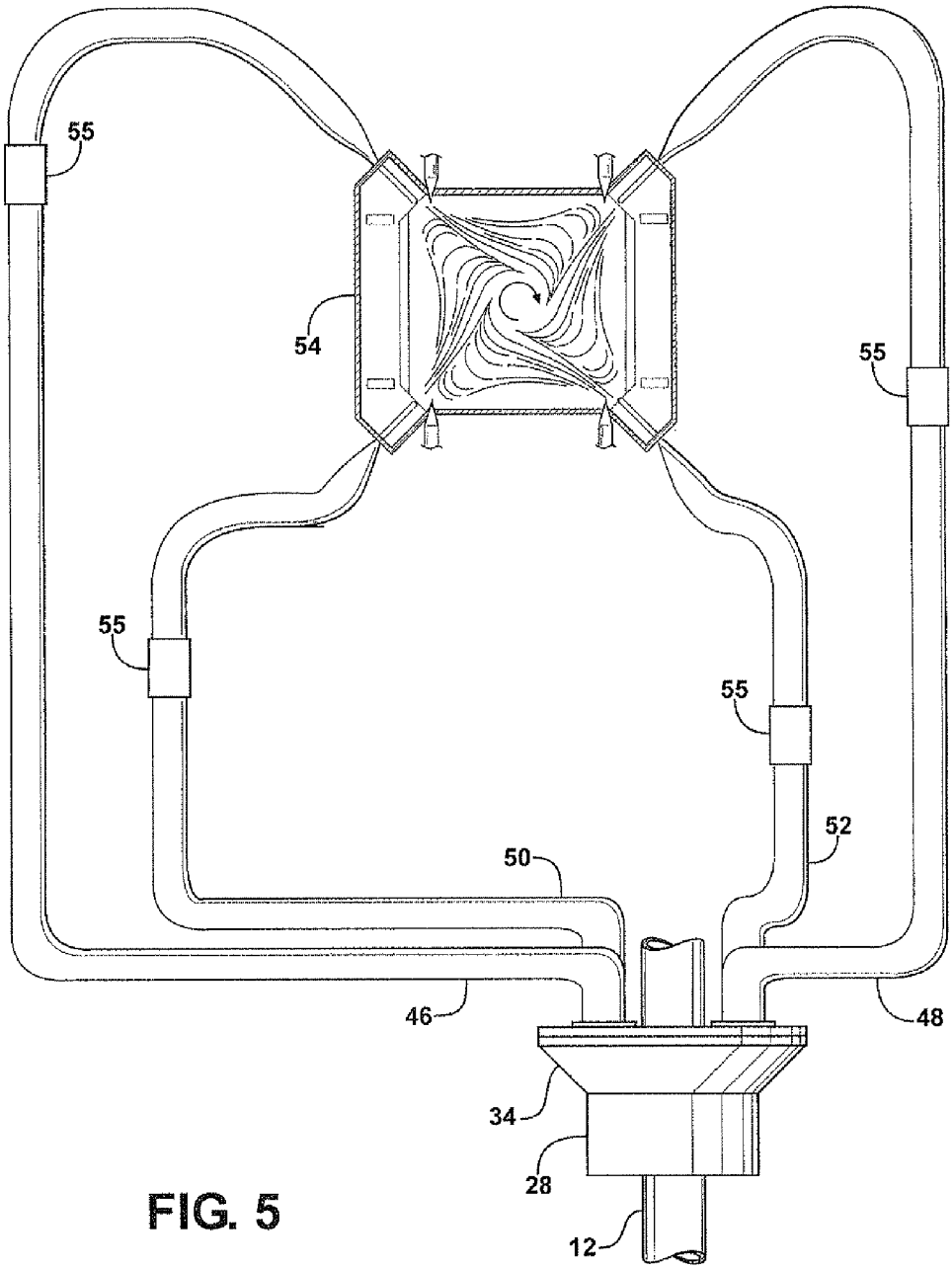
FIG. 5 is a diagram of a portion of the pulverizer/classifier as shown in FIG. 4 further indicating the use of a diffusion device in the classifier skirt and showing the manner in which the outflow conduits are attached to a combustion chamber or firebox in a coal fired boiler.
Figure 6:
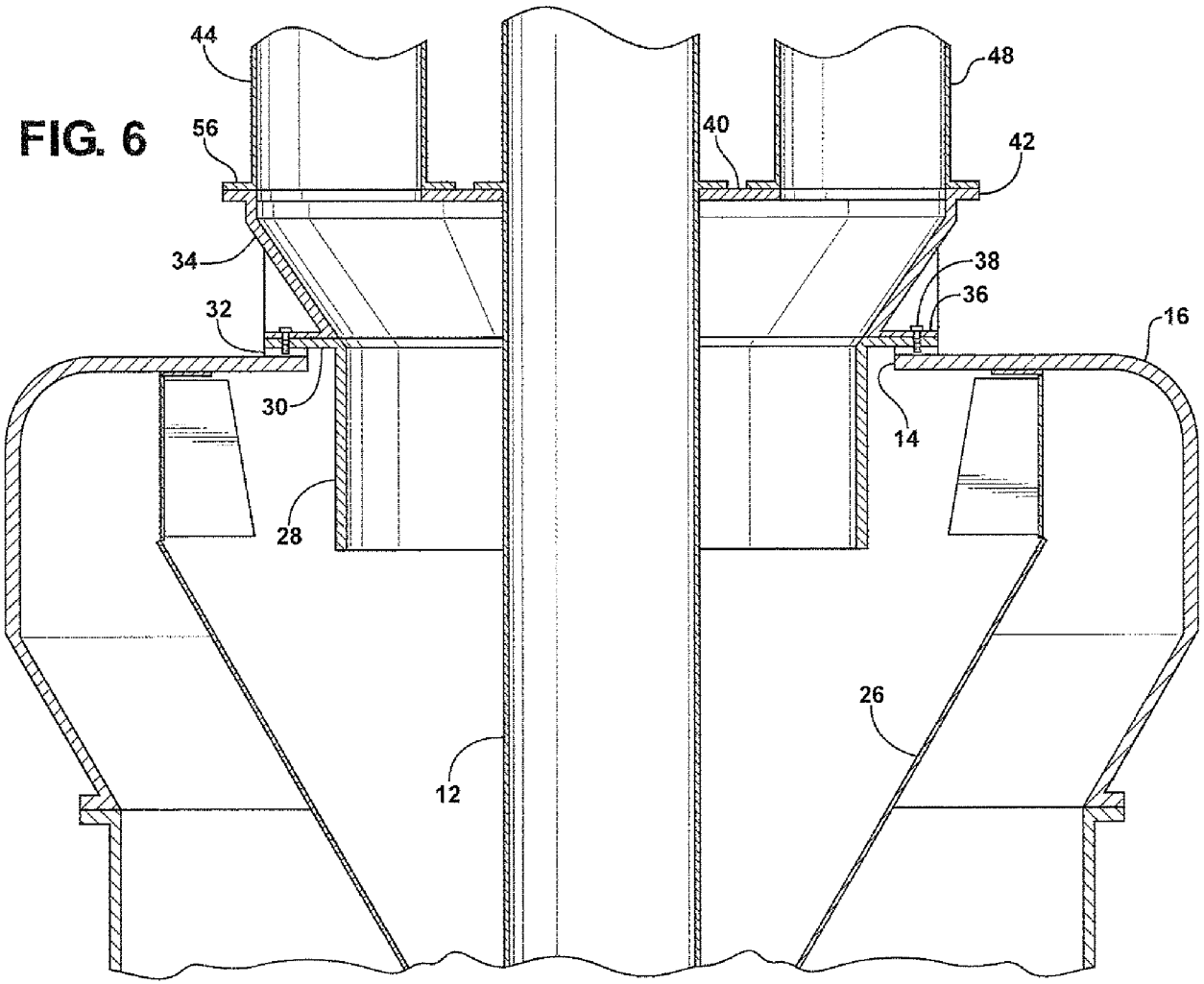
FIG. 6 is a detailed cross-sectional view of the upper structure of the pulverizer/classifier as shown in FIG. 4 and illustrating the replacement structure in greater detail.
Figure 7:
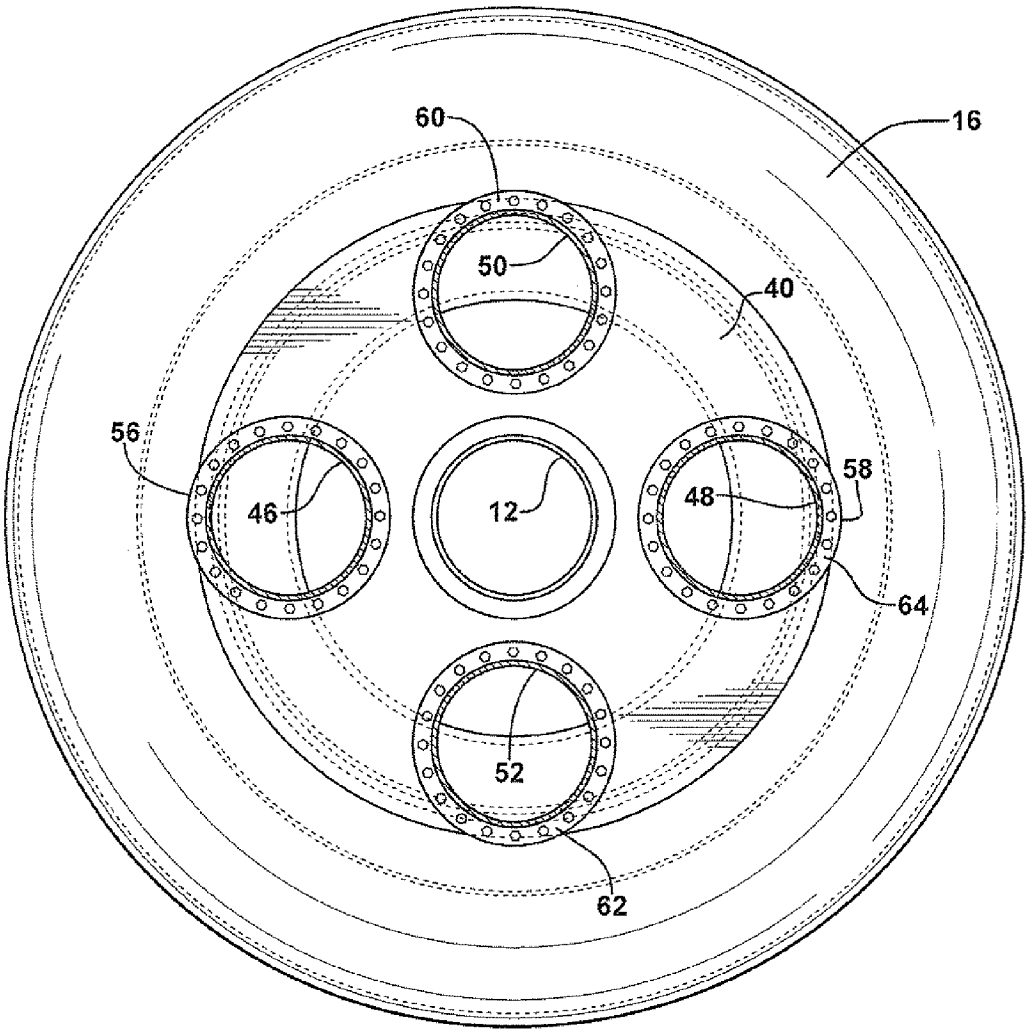
FIG. 7 is a top view of the structure of FIG. 6.

Referring to FIGS. 4, 5 and 6, there is shown a coal pulverizer/classifier 10 of the type shown partially in FIG. 1, but after removal of the outlet structure of FIGS. 1-3 and conversion to the simple multi-port turret type outlet hereinafter described. In this instance, the OEM outlet structure of FIGS. 1-3 has been entirely removed. The components removed include the skirt 72, the plate 82, the transition tubes 84, 88, and 90, and the Venturi 70. The chute 12 may be temporarily removed but is later reinstalled. This type of classifier has a centrally located gravity feed coal inlet chute 12 which, after conversion, extends downwardly into the interior of the pulverizer/classifier 10 through a central opening 14 in the top structure 16. The chute extends downwardly to an outlet structure 13 which is located immediately above a rotatable crusher table 18 on which a number of crusher wheels 20 operate to pulverize lump coal into smaller and smaller pieces until a fine powdery substance is obtained. The crusher wheels 20 are mounted to the side structure of the pulverizer/classifier 10 by means of pivots 22 and adjustable spring suspension systems 24. More detail is given in U.S. Pat. No. 7,100,853, the disclosure of which is incorporated herein by reference.

Conical shield 26, in OEM structure left in place, is mounted in surrounding relationship to the chute 12 and with the outlet structure 13 to divert coal fines upwardly where they pass around the top of the shield and down into a conical volume from which the lighter fines may continue to travel upwardly in the updraft air stream created by the pulverizer/classifier into a generally cylindrical replacement classifier skirt 28 having a top flange 30 which mates with and rests on the annular seat 32 surrounding the opening 14. The classifier skirt 28 is spaced coaxially and concentrically with the infeed chute 12 and in spaced relationship therewith to create a large annular flow volume which exits the top structure 16 of the pulverizer/classifier. If the OEM skirt 72 is in good condition and dimensionally correct, it may be reused. In this example, a replacement skirt 28 is installed.

Mounted on the seat 32 around opening 14 and in coaxial and contiguous relationship to the classifier skirt 28 is a conical turret 34 having an upwardly and outwardly diverging sidewall fitted with a bottom flange 36 which rests on the flange 30 of the classifier skirt and is secured thereto by a series of bolts 38. The turret has a top wall 40 which terminates in an outboard flange 42. The turret 34 defines a second upward flow volume which is a continuation of the upward flow volume defined within the interior of the classifier skirt 28. Skirt 28 and turret 34 can be made in one piece with a single mounting flange at 36.

The top wall 40 has a plurality of circular openings formed therein which are adapted to receive the coal fine outflow conduits 44, 46, 48 and 50, each of which is provided with an end flange 56, 58, 60 and 62, respectively, to mate with and be secured to the top wall 40 in surrounding and concentric relationship with the openings in the top wall 40. These are likely OEM conduits and may not need to be replaced.

As shown in FIG. 5, the classifier skirt 28 is adapted to receive therein a spin-type mixer of the type described in U.S. Pat. No. 6,899,041, the disclosure of which is incorporated herein by reference.

Referring again to FIG. 5, the turret assembly 34 is connected to the outflow conduits 46, 48, 50 and 52 which are connected to the four corners of a firebox 54 where the coal fines are injected using conventional firing technology to create a fireball which is used to boil water and create steam to turn a turbine in the usual fashion. Valve structures 55 may be inserted into the conduits for flow adjustment to balance the flow to the firebox 54.

As indicated above, the materials of construction for the classifier skirt 28 and turret assembly 34 as shown in FIG. 5 may take any of several forms including wear resistant carbides and cermets as well as steel with welded wear plates or alloy wear surfaces, all as will be apparent to persons skilled in the art.

It is further to be appreciated that the exact pulverizer/classifier structure as shown in FIGS. 5 and 6 is illustrative only in that other types of pulverizers/classifiers with other types of crusher suspension systems and interior arrangements are equally eligible to benefit from the use of the present invention. The invention is readily installed in the field as both original equipment and replacement equipment for the conventional structure described above.

What is claimed is:

1. A method of converting a classifier of the type having an upper housing with a central top opening, a coal feed chute passing through said top opening into the interior of the classifier, and an upper structure comprising a venturi, an annular plate with four kidney-shaped openings, and four kidney-to-round transition tubes mounted over said kidney-shaped openings and connected to respective combustion chamber feed conduits, wherein the method comprises the steps of:

disconnecting the transition tubes from the combustion chamber feed conduits;

removing the upper structure from the classifier;

installing a diverging-volume turret having four outlet ports on the top opening; and reconnecting the outlet ports to the combustion chamber feed conduits.

2. A method as defined in claim 1 wherein the upper structure further comprises an annular skirt coaxial with and in surrounding relationship with the venturi including the further steps of:

(a) removing the skirt; and (b) replacing the skirt with one adapted to receive a multi-spin mixer.

3. The method of claim 2 including the further step of installing a multi-spin mixer in the replacement skirt.

4. The method of claim 1 wherein the diverging-volume turret is conical, is secured to said top opening in coaxial relationship therewith and having an upwardly diverging sidewall forming an upward flow volume which is in communication with the classifier interior;

said turret further having a top wall secured to said diverging sidewall and having formed therein a plurality of uniformly spaced outlet openings for connection to coal outflow conduits.

5. The method described in claim 4 wherein the outlet openings are four in number.

6. The method described in claim 4 further comprising the use of wear resistant materials to construct one or more portions of the skirt and turret.

7. The method as described in claim 4 further comprising installing a spin-type mixer disposed within the classifier skirt.

* * * * *